US005423539A

United States Patent [19]

Nagao

[11] Patent Number: 5,423,539

[45] Date of Patent: * Jun. 13, 1995

[54] SLOT MACHINE WITH PAYOUT MODIFYING SYMBOLS

[75] Inventor: Yuji Nagao, Tokyo, Japan

[73] Assignee: Sigma, Incorporated, Tokyo, Japan

[ * ] Notice: The portion of the term of this patent subsequent to May 11, 2010 has been disclaimed.

[21] Appl. No.: 83,875

[22] Filed: Jun. 30, 1993

Related U.S. Application Data

[63] Continuation of Ser. No. 412,985, Sep. 26, 1989, abandoned.

[51] Int. Cl.[6] ..... A63F 7/00; G07F 17/34

[52] U.S. Cl. ..... 273/143 R; 273/138 A

[58] Field of Search ..... 273/138 R, 138 A, 143 R, 273/143 B, 143 C, 143 D, 143 E

[56] References Cited

U.S. PATENT DOCUMENTS

| | | | |
|---|---|---|---|
| 4,184,683 | 1/1980 | Hooker | 273/143 R |
| 4,570,934 | 2/1986 | Smyth | 273/138 A |
| 4,711,451 | 12/1987 | Pajak et al. | 273/143 R |
| 4,712,799 | 12/1987 | Fraley | 273/138 A |
| 4,721,307 | 1/1988 | Okada | 273/143 R |
| 4,772,023 | 9/1988 | Okada . | |
| 4,838,552 | 6/1989 | Hagiwara | 273/138 A |
| 5,209,479 | 5/1993 | Nagao et al. | 273/143 A |

FOREIGN PATENT DOCUMENTS

| | | | |
|---|---|---|---|
| 0058488 | 8/1982 | European Pat. Off. | 273/138 A |
| 793198 | 1/1936 | France . | |
| 2092797 | 8/1982 | United Kingdom . | |
| 2182186 | 5/1987 | United Kingdom | 273/143 R |
| WO8605407 | 9/1986 | WIPO . | |

*Primary Examiner*—Paul E. Shapiro
*Assistant Examiner*—William M. Pierce
*Attorney, Agent, or Firm*—Stevens, Davis, Miller & Mosher

[57] ABSTRACT

This invention relates a game machine in which a combination of characters stopped along a winning line is judged based on a winning table showing winning combinations of characters to determine the presence of a win and a payment of coins. In this game machine, a substitutable character can be used as another character, and when its substitution makes a combination of characters a winning combination, a payment of coins for the combination is increased or decreased to determine a new payment of coins.

23 Claims, 23 Drawing Sheets

| Hit Combinations | 1 Coin | 2 Coin | 3 Coin |
|---|---|---|---|
| Angel : Angel : Angel : | 600 | 1200 | 1800 |
| Devil : Devil : Devil : | 200 | 400 | 600 |
| 7 Bar : 7 Bar : 7 Bar : | 100 | 200 | 300 |
| 3 Bar : 3 Bar : 3 Bar : | 60 | 120 | 180 |
| 2 Bar : 2 Bar : 2 Bar : | 40 | 80 | 120 |
| 1 Bar : 1 Bar : 1 Bar : | 10 | 20 | 30 |
| 0 Bar : 0 Bar : 0 Bar : | 7 | 14 | 21 |
| A Bar : A Bar : A Bar : | 5 | 10 | 15 |
| 0 Bar : 0 Bar : - : | 2 | 4 | 6 |

Fig. 1 (PRIOR ART)

| STOP POSITION | 1ST REEL | 2ND REEL | 3RD REEL |
|---|---|---|---|
| 1 | 7B | 7B | 7B |
| 2 | 7B | 7B | BL |
| 3 | BL | BL | BL |
| 4 | BL | BL | 1B |
| 5 | 1B | 1B | BL |
| 6 | BL | BL | BL |
| 7 | 5B | 5B | 5B |
| 8 | BL | BL | BL |
| 9 | BL | BL | BL |
| 10 | 1B | 1B | 1B |
| 11 | BL | BL | BL |
| 12 | BL | BL | BL |
| 13 | 5B | 5B | 5B |
| 14 | BL | BL | BL |
| 15 | 1B | BL | BL |
| 16 | 1B | 1B | 1B |

Fig. 5

| Hit Combinations | 1 Coin | 2 Coin | 3 Coin |
|---|---|---|---|
| Angel : Angel : Angel : | 600 | 1200 | 1800 |
| Devil : Devil : Devil : | 200 | 400 | 600 |
| 7 Bar : 7 Bar : 7 Bar : | 100 | 200 | 300 |
| 3 Bar : 3 Bar : 3 Bar : | 60 | 120 | 180 |
| 2 Bar : 2 Bar : 2 Bar : | 40 | 80 | 120 |
| 1 Bar : 1 Bar : 1 Bar : | 10 | 20 | 30 |
| 0 Bar : 0 Bar : 0 Bar : | 7 | 14 | 21 |
| A Bar : A Bar : A Bar : | 5 | 10 | 15 |
| 0 Bar : 0 Bar : - : | 2 | 4 | 6 |

Fig.6 A

| | | | |
|---|---|---|---|
| No. | 1st REEL | 2nd REEL | 3rd REEL |
| 0 | Angel | Angel | Angel |
| 1 | | | |
| 2 | 1 Bar | 1 Bar | 0 Bar |
| 3 | | | |
| 4 | 3 Bar | 2 Bar | 1 Bar |
| 5 | | | |
| 6 | 7 Bar | 7 Bar | 7 Bar |
| 7 | | | |
| 8 | 3 Bar | 3 Bar | 1 Bar |
| 9 | | | |
| 10 | 0 Bar | 1 Bar | 1 Bar |
| 11 | | | |
| 12 | Devil | Devil | Devil |
| 13 | | | |
| 14 | 3 Bar | 1 Bar | 0 Bar |
| 15 | | | |
| 16 | 2 Bar | 2 Bar | 3 Bar |
| 17 | | | |
| 18 | 7 Bar | 1 Bar | 1 Bar |
| 19 | | | |
| 20 | 2 Bar | 3 Bar | 2 Bar |
| 21 | | | |
| 22 | 1 Bar | 0 Bar | 0 Bar |
| 23 | | | |
| Angel | 1 | 1 | 1 |
| Devil | 1 | 1 | 1 |
| 7 Bar | 2 | 1 | 1 |
| 3 Bar | 3 | 2 | 1 |
| 2 Bar | 2 | 2 | 1 |
| 1 Bar | 2 | 4 | 4 |
| 0 Bar | 1 | 1 | 3 |
| Blank | 12 | 12 | 12 |
| Total | 24 | 24 | 24 |
| | | | |
| Tape No | Reel 1 | Reel 2 | Reel 3 |

Fig.6 B

| No. | 1st REEL | 2nd REEL | 3rd REEL |
|---|---|---|---|
| 0 | Angel | Angel | Angel |
| 1 | | 1 Bar | |
| 2 | 1 Bar | 2 Bar | 0 Bar |
| 3 | 1 Bar | | 1 Bar |
| 4 | 1 Bar | 7 Bar | 7 Bar |
| 5 | 1 Bar | 3 Bar | |
| 6 | | 1 Bar | 1 Bar |
| 7 | 3 Bar | | 1 Bar |
| 8 | | Devil | Devil |
| 9 | 7 Bar | 1 Bar | |
| 10 | | 2 Bar | 0 Bar |
| 11 | 3 Bar | | 3 Bar |
| 12 | | 1 Bar | 1 Bar |
| 13 | 0 Bar | 3 Bar | |
| 14 | 0 Bar | 0 Bar | 2 Bar |
| 15 | | | 0 Bar |
| 16 | Devil | | |
| 17 | | | |
| 18 | 3 Bar | | |
| 19 | | | |
| 20 | 2 Bar | | |
| 21 | 2 Bar | | |
| 22 | | | |
| 23 | 7 Bar | | |
| 24 | | | |
| 25 | 2 Bar | | |
| 26 | | | |
| 27 | 1 Bar | | |
| 28 | 1 Bar | | |
| 29 | 1 Bar | | |
| 30 | 1 Bar | | |
| 31 | | | |
| | | | |
| Angel | 1 | 1 | 1 |
| Devil | 1 | 1 | 1 |
| 7 Bar | 2 | 1 | 1 |
| 3 Bar | 3 | 2 | 1 |
| 2 Bar | 3 | 2 | 1 |
| 1 Bar | 8 | 4 | 4 |
| 0 Bar | 2 | 1 | 3 |
| Blank | 12 | 4 | 4 |
| Total | 32 | 16 | 16 |
| | | | |
| Tape NO | Reel 1 | Reel 2 | Reel 3 |

Fig. 7 A

| | | | |
|---|---|---|---|
| No. | 1st REEL | 2nd REEL | 3rd REEL |
| 0 | Angel | Angel | Angel |
| 1 | | | |
| 2 | 1 Bar | 1 Bar | 0 Bar |
| 3 | | | |
| 4 | 3 Bar | 2 Bar | 1 Bar |
| 5 | | | |
| 6 | 7 Bar | 7 Bar | 7 Bar |
| 7 | | | |
| 8 | 3 Bar | 3 Bar | 1 Bar |
| 9 | | | |
| 10 | 0 Bar | 1 Bar | 1 Bar |
| 11 | | | |
| 12 | Devil | Devil | Devil |
| 13 | | | |
| 14 | 3 Bar | 1 Bar | 0 Bar |
| 15 | | | |
| 16 | 2 Bar | 2 Bar | 3 Bar |
| 17 | | | |
| 18 | 7 Bar | 1 Bar | 1 Bar |
| 19 | | | |
| 20 | 2 Bar | 3 Bar | 2 Bar |
| 21 | | | |
| 22 | 1 Bar | 0 Bar | 0 Bar |
| 23 | | | |
| Angel | 1 | 1 | 1 |
| Devil | 1 | 1 | 1 |
| 7 Bar | 2 | 1 | 1 |
| 3 Bar | 3 | 2 | 1 |
| 2 Bar | 2 | 2 | 1 |
| 1 Bar | 2 | 4 | 4 |
| 0 Bar | 1 | 1 | 3 |
| Blank | 12 | 12 | 12 |
| Total | 24 | 24 | 24 |
| | | | |
| Tape No | Reel 1 | Reel 2 | Reel 3 |

Fig. 7 B

| No. | 1st REEL | 2nd REEL | 3rd REEL |
|---|---|---|---|
| 0 | Angel | Angel | Angel |
| 1 | | | |
| 2 | 1 Bar | | |
| 3 | 1 Bar | 1 Bar | |
| 4 | 1 Bar | 1 Bar | |
| 5 | 1 Bar | | |
| 6 | | 2 Bar | 0 Bar |
| 7 | 3 Bar | | 0 Bar |
| 8 | | 7 Bar | 0 Bar |
| 9 | 7 Bar | | |
| 10 | | 3 Bar | 1 Bar |
| 11 | 3 Bar | | |
| 12 | | 1 Bar | |
| 13 | 0 Bar | | |
| 14 | 0 Bar | Devil | |
| 15 | | | |
| 16 | Devil | 1 Bar | 7 Bar |
| 17 | | | |
| 18 | 3 Bar | 2 Bar | |
| 19 | | | |
| 20 | 2 Bar | 1 Bar | |
| 21 | 2 Bar | | |
| 22 | | 3 Bar | 1 Bar |
| 23 | 7 Bar | | |
| 24 | | 0 Bar | 1 Bar |
| 25 | 2 Bar | 0 Bar | |
| 26 | | | |
| 27 | 1 Bar | | |
| 28 | 1 Bar | | |
| 29 | 1 Bar | | |
| 30 | 1 Bar | | Devil |

Fig. 7C

| No. | 1st REEL | 2nd REEL | 3rd REEL |
|---|---|---|---|
| 31 | | | |
| 32 | | | |
| 33 | | | |
| 34 | | | |
| 35 | | | |
| 36 | | | 0 Bar |
| 37 | | | 0 Bar |
| 38 | | | |
| 39 | | | |
| 40 | | | 3 Bar |
| 41 | | | |
| 42 | | | |
| 43 | | | 1 Bar |
| 44 | | | |
| 45 | | | 2 Bar |
| 46 | | | |
| 47 | | | 0 Bar |
| 48 | | | 0 Bar |
| 49 | | | |
| 50 | | | |
| 51 | | | |
| 52 | | | |
| 53 | | | |
| Angel | 1 | 1 | 1 |
| Devil | 1 | 1 | 1 |
| 7 Bar | 2 | 1 | 1 |
| 3 Bar | 3 | 2 | 1 |
| 2 Bar | 3 | 2 | 1 |
| 1 Bar | 8 | 5 | 4 |
| 0 Bar | 2 | 2 | 7 |
| Blank | 12 | 14 | 38 |
| Total | 32 | 28 | 54 |
| | | | |
| Tape No | Reel 1 | Reel 2 | Reel 3 |

Fig.8 A

| | | | |
|---|---|---|---|
| No. | 1st REEL | 2nd REEL | 3rd REEL |
| 0 | Angel | Angel | Angel |
| 1 | | | |
| 2 | 1 Bar | 1 Bar | 0 Bar |
| 3 | | | |
| 4 | 3 Bar | 2 Bar | 1 Bar |
| 5 | | | |
| 6 | 7 Bar | 7 Bar | 7 Bar |
| 7 | | | |
| 8 | 3 Bar | 3 Bar | 1 Bar |
| 9 | | | |
| 10 | 0 Bar | 1 Bar | 1 Bar |
| 11 | | | |
| 12 | Devil | Devil | Devil |
| 13 | | | |
| 14 | 3 Bar | 1 Bar | 0 Bar |
| 15 | | | |
| 16 | 2 Bar | 2 Bar | 3 Bar |
| 17 | | | |
| 18 | 7 Bar | 1 Bar | 1 Bar |
| 19 | | | |
| 20 | 2 Bar | 3 Bar | 2 Bar |
| 21 | | | |
| 22 | 1 Bar | 0 Bar | 0 Bar |
| 23 | | | |
| Angel | 1 | 1 | 1 |
| Devil | 1 | 1 | 1 |
| 7 Bar | 2 | 1 | 1 |
| 3 Bar | 3 | 2 | 1 |
| 2 Bar | 2 | 2 | 1 |
| 1 Bar | 2 | 4 | 4 |
| 0 Bar | 1 | 1 | 3 |
| Blank | 12 | 12 | 12 |
| Total | 24 | 24 | 24 |
| | | | |
| Tape No | Reel 1 | Reel 2 | Reel 3 |

Fig. 8 B

| No. | 1st REEL | 2nd REEL | 3rd REEL |
|---|---|---|---|
| 0 | Angel | Angel | Angel |
| 1 | | | |
| 2 | 1 Bar | | |
| 3 | 1 Bar | | |
| 4 | 1 Bar | 1 Bar | |
| 5 | 1 Bar | 1 Bar | |
| 6 | | | 0 Bar |
| 7 | 3 Bar | 2 Bar | 0 Bar |
| 8 | | | 0 Bar |
| 9 | 7 Bar | 7 Bar | |
| 10 | | | 1 Bar |
| 11 | 3 Bar | 3 Bar | |
| 12 | | | |
| 13 | 0 Bar | 1 Bar | |
| 14 | 0 Bar | | |
| 15 | | Devil | |
| 16 | Devil | | 7 Bar |
| 17 | | 1 Bar | |
| 18 | 3 Bar | | |
| 19 | | 2 Bar | |
| 20 | 2 Bar | | |
| 21 | 2 Bar | 1 Bar | |
| 22 | | | 1 Bar |
| 23 | 7 Bar | 3 Bar | |
| 24 | | | 1 Bar |
| 25 | 2 Bar | 0 Bar | |
| 26 | | | |
| 27 | 1 Bar | | |
| 28 | 1 Bar | | |
| 29 | 1 Bar | | |
| 30 | 1 Bar | | Devil |

Fig.8C

| No. | 1st REEL | 2nd REEL | 3rd REEL |
|---|---|---|---|
| 31 | | | |
| 32 | | | |
| 33 | | | |
| 34 | | | |
| 35 | | | |
| 36 | | | 0 Bar |
| 37 | | | 0 Bar |
| 38 | | | 0 Bar |
| 39 | | | |
| 40 | | | 3 Bar |
| 41 | | | |
| 42 | | | 1 Bar |
| 43 | | | |
| 44 | | | 2 Bar |
| 45 | | | |
| 46 | | | 0 Bar |
| 47 | | | 0 Bar |
| 48 | | | 0 Bar |
| 49 | | | |
| 50 | | | |
| 51 | | | |
| 52 | | | |
| 53 | | | |
| Angel | 1 | 1 | 1 |
| Devil | 1 | 1 | 1 |
| 7 Bar | 2 | 1 | 1 |
| 3 Bar | 3 | 2 | 1 |
| 2 Bar | 3 | 2 | 1 |
| 1 Bar | 8 | 5 | 4 |
| 0 Bar | 2 | 1 | 9 |
| Blank | 12 | 15 | 36 |
| Total | 32 | 28 | 54 |
| | | | |
| Tape No | Reel 1 | Reel 2 | Reel 3 |

Fig. 9 A

| No. Reel Combinations | Hit Combinations | Max Odds |
|---|---|---|
| 1 : Angel : Angel : Angel : | Angel : Angel : Angel : | 1800 |
| 2 : Angel : Angel : Devil : | Angel : Angel : Angel : | 1800 |
| 3 : Angel : Angel : 7 Bar : | Angel : Angel : Angel : | 1800 |
| 4 : Devil : Devil : Devil : | Devil : Devil : Devil : | 600 |
| 5 : Angel : 7 Bar : 7 Bar : | Devil : Devil : Devil : | 600 |
| 6 : Angel : Angel : 3 Bar : | Devil : Devil : Devil : | 600 |
| 7 : Angel : Devil : Devil : | 7 Bar : 7 Bar : 7 Bar : | 300 |
| 8 : Angel : Angel : 2 Bar : | 7 Bar : 7 Bar : 7 Bar : | 300 |
| 9 : Angel : Devil : 7 Bar : | 7 Bar : 7 Bar : 7 Bar : | 300 |
| 10 : 7 Bar : 7 Bar : 7 Bar : | 7 Bar : 7 Bar : 7 Bar : | 300 |
| 11 : Angel : 3 Bar : 3 Bar : | 7 Bar : 7 Bar : 7 Bar : | 300 |
| 12 : Angel : Devil : 3 Bar : | 3 Bar : 3 Bar : 3 Bar : | 180 |
| 13 : Devil : 7 Bar : 7 Bar : | 3 Bar : 3 Bar : 3 Bar : | 180 |
| 14 : Angel : Angel : 1 Bar : | 3 Bar : 3 Bar : 3 Bar : | 180 |
| 15 : 3 Bar : 3 Bar : 3 Bar : | 3 Bar : 3 Bar : 3 Bar : | 180 |
| 16 : Angel : 2 Bar : 2 Bar : | 3 Bar : 3 Bar : 3 Bar : | 180 |
| 17 : Devil : Devil : 7 Bar : | 2 Bar : 2 Bar : 2 Bar : | 120 |
| 18 : Angel : Devil : 2 Bar : | 2 Bar : 2 Bar : 2 Bar : | 120 |
| 19 : Devil : 3 Bar : 3 Bar : | 2 Bar : 2 Bar : 2 Bar : | 120 |
| 20 : Angel : Angel : 0 Bar : | 2 Bar : 2 Bar : 2 Bar : | 120 |
| 21 : 2 Bar : 2 Bar : 2 Bar : | 2 Bar : 2 Bar : 2 Bar : | 120 |
| 22 : Angel : 1 Bar : 1 Bar : | 2 Bar : 2 Bar : 2 Bar : | 120 |
| 23 : Devil : Devil : 3 Bar : | 1 Bar : 1 Bar : 1 Bar : | 30 |
| 24 : Angel : Devil : 1 Bar : | 1 Bar : 1 Bar : 1 Bar : | 30 |
| 25 : Devil : 2 Bar : 2 Bar : | 1 Bar : 1 Bar : 1 Bar : | 30 |
| 26 : 1 Bar : 1 Bar : 1 Bar : | 1 Bar : 1 Bar : 1 Bar : | 30 |
| 27 : Angel : 0 Bar : 0 Bar : | 1 Bar : 1 Bar : 1 Bar : | 30 |
| 28 : Angel : 2 Bar : 0 Bar : | 0 Bar : 0 Bar : 0 Bar : | 21 |
| 29 : Devil : Devil : 2 Bar : | 0 Bar : 0 Bar : 0 Bar : | 21 |
| 30 : Angel : Devil : 0 Bar : | 0 Bar : 0 Bar : 0 Bar : | 21 |
| 31 : Devil : 1 Bar : 1 Bar : | 0 Bar : 0 Bar : 0 Bar : | 21 |
| 32 : Angel : Angel : Blank : | 0 Bar : 0 Bar : 0 Bar : | 21 |
| 33 : Angel : 2 Bar : 1 Bar : | 0 Bar : 0 Bar : 0 Bar : | 21 |
| 34 : 0 Bar : 0 Bar : 0 Bar : | 0 Bar : 0 Bar : 0 Bar : | 21 |
| 35 : Angel : 7 Bar : 3 Bar : | 0 Bar : 0 Bar : 0 Bar : | 21 |
| 36 : Angel : 7 Bar : 2 Bar : | 0 Bar : 0 Bar : 0 Bar : | 21 |
| 37 : Angel : 7 Bar : 1 Bar : | 0 Bar : 0 Bar : 0 Bar : | 21 |
| 38 : Angel : 7 Bar : 0 Bar : | 0 Bar : 0 Bar : 0 Bar : | 21 |
| 39 : Angel : 3 Bar : 2 Bar : | 0 Bar : 0 Bar : 0 Bar : | 21 |
| 40 : Angel : 3 Bar : 1 Bar : | 0 Bar : 0 Bar : 0 Bar : | 21 |
| 41 : Angel : 3 Bar : 0 Bar : | 0 Bar : 0 Bar : 0 Bar : | 21 |
| 42 : Angel : 1 Bar : 0 Bar : | 0 Bar : 0 Bar : 0 Bar : | 21 |

Fig. 9 B

| No. Reel Combinations | Hit Combinations | Max Odds |
|---|---|---|
| 43 : Devil : Devil : 1 Bar : | A Bar : A Bar : A Bar : | 15 |
| 44 : Devil : 0 Bar : 0 Bar : | A Bar : A Bar : A Bar : | 15 |
| 45 : 1 Bar : 0 Bar : 0 Bar : | A Bar : A Bar : A Bar : | 15 |
| 46 : 1 Bar : 1 Bar : 0 Bar : | A Bar : A Bar : A Bar : | 15 |
| 47 : 2 Bar : 0 Bar : 0 Bar : | A Bar : A Bar : A Bar : | 15 |
| 48 : 2 Bar : 1 Bar : 0 Bar : | A Bar : A Bar : A Bar : | 15 |
| 49 : 2 Bar : 1 Bar : 1 Bar : | A Bar : A Bar : A Bar : | 15 |
| 50 : 2 Bar : 2 Bar : 0 Bar : | A Bar : A Bar : A Bar : | 15 |
| 51 : 2 Bar : 2 Bar : 1 Bar : | A Bar : A Bar : A Bar : | 15 |
| 52 : 3 Bar : 0 Bar : 0 Bar : | A Bar : A Bar : A Bar : | 15 |
| 53 : 3 Bar : 1 Bar : 0 Bar : | A Bar : A Bar : A Bar : | 15 |
| 54 : 3 Bar : 1 Bar : 1 Bar : | A Bar : A Bar : A Bar : | 15 |
| 55 : 7 Bar : 7 Bar : 3 Bar : | A Bar : A Bar : A Bar : | 15 |
| 56 : 7 Bar : 7 Bar : 2 Bar : | A Bar : A Bar : A Bar : | 15 |
| 57 : 7 Bar : 7 Bar : 1 Bar : | A Bar : A Bar : A Bar : | 15 |
| 58 : 7 Bar : 7 Bar : 0 Bar : | A Bar : A Bar : A Bar : | 15 |
| 59 : 7 Bar : 3 Bar : 3 Bar : | A Bar : A Bar : A Bar : | 15 |
| 60 : 7 Bar : 3 Bar : 2 Bar : | A Bar : A Bar : A Bar : | 15 |
| 61 : 7 Bar : 3 Bar : 1 Bar : | A Bar : A Bar : A Bar : | 15 |
| 62 : 7 Bar : 3 Bar : 0 Bar : | A Bar : A Bar : A Bar : | 15 |
| 63 : 7 Bar : 2 Bar : 2 Bar : | A Bar : A Bar : A Bar : | 15 |
| 64 : 7 Bar : 2 Bar : 1 Bar : | A Bar : A Bar : A Bar : | 15 |
| 65 : 7 Bar : 2 Bar : 0 Bar : | A Bar : A Bar : A Bar : | 15 |
| 66 : 7 Bar : 1 Bar : 1 Bar : | A Bar : A Bar : A Bar : | 15 |
| 67 : 7 Bar : 1 Bar : 0 Bar : | A Bar : A Bar : A Bar : | 15 |
| 68 : 7 Bar : 0 Bar : 0 Bar : | A Bar : A Bar : A Bar : | 15 |
| 69 : 3 Bar : 3 Bar : 2 Bar : | A Bar : A Bar : A Bar : | 15 |
| 70 : 3 Bar : 3 Bar : 1 Bar : | A Bar : A Bar : A Bar : | 15 |
| 71 : 3 Bar : 3 Bar : 0 Bar : | A Bar : A Bar : A Bar : | 15 |
| 72 : 3 Bar : 2 Bar : 2 Bar : | A Bar : A Bar : A Bar : | 15 |
| 73 : 3 Bar : 2 Bar : 1 Bar : | A Bar : A Bar : A Bar : | 15 |
| 74 : 3 Bar : 2 Bar : 0 Bar : | A Bar : A Bar : A Bar : | 15 |
| 75 : Angel : 0 Bar : Blank : | A Bar : A Bar : A Bar : | 15 |
| 76 : Devil : 2 Bar : 0 Bar : | 0-Bar : 0-Bar : - : | 6 |
| 77 : Devil : 2 Bar : 1 Bar : | 0-Bar : 0-Bar : - : | 6 |
| 78 : Devil : 3 Bar : 0 Bar : | 0-Bar : 0-Bar : - : | 6 |
| 79 : Devil : 3 Bar : 1 Bar : | 0-Bar : 0-Bar : - : | 6 |
| 80 : Devil : 3 Bar : 2 Bar : | 0-Bar : 0-Bar : - : | 6 |
| 81 : Devil : 7 Bar : 0 Bar : | 0-Bar : 0-Bar : - : | 6 |
| 82 : Devil : 7 Bar : 1 Bar : | 0-Bar : 0-Bar : - : | 6 |
| 83 : Devil : 7 Bar : 2 Bar : | 0-Bar : 0-Bar : - : | 6 |
| 84 : Devil : 7 Bar : 3 Bar : | 0-Bar : 0-Bar : - : | 6 |
| 85 : Devil : Devil : 0 Bar : | 0-Bar : 0-Bar : - : | 6 |
| 86 : Angel : Devil : Blank : | 0-Bar : 0-Bar : - : | 6 |
| 87 : Devil : 1 Bar : 0 Bar : | 0-Bar : 0-Bar : - : | 6 |
| 88 : 0 Bar : 0 Bar : Blank : | 0-Bar : 0-Bar : - : | 6 |

Fig. 11A

| | | | |
|---|---|---|---|
| No. | 1st REEL | 2nd REEL | 3rd REEL |
| 0 | Angel | Angel | Angel |
| 1 | | | |
| 2 | 1 Bar | 1 Bar | 0 Bar |
| 3 | | | |
| 4 | 3 Bar | 2 Bar | 1 Bar |
| 5 | | | |
| 6 | 7 Bar | 7 Bar | 7 Bar |
| 7 | | | |
| 8 | 3 Bar | 3 Bar | 1 Bar |
| 9 | | | |
| 10 | 0 Bar | 1 Bar | 1 Bar |
| 11 | | | |
| 12 | Devil | Devil | Devil |
| 13 | | | |
| 14 | 3 Bar | 1 Bar | 0 Bar |
| 15 | | | |
| 16 | 2 Bar | 2 Bar | 3 Bar |
| 17 | | | |
| 18 | 7 Bar | 1 Bar | 1 Bar |
| 19 | | | |
| 20 | 2 Bar | 3 Bar | 2 Bar |
| 21 | | | |
| 22 | 1 Bar | 0 Bar | 0 Bar |
| 23 | | | |
| Angel | 1 | 1 | 1 |
| Devil | 1 | 1 | 1 |
| 7 Bar | 2 | 1 | 1 |
| 3 Bar | 3 | 2 | 1 |
| 2 Bar | 2 | 2 | 1 |
| 1 Bar | 2 | 4 | 4 |
| 0 Bar | 1 | 1 | 3 |
| Blank | 12 | 12 | 12 |
| Total | 24 | 24 | 24 |
| | | | |
| Tape No | Reel 1 | Reel 2 | Reel 3 |

Fig.11B

| No. | 1st REEL | 2nd REEL | 3rd REEL |
|---|---|---|---|
| 0 | Angel | Angel | Angel |
| 1 | | | |
| 2 | 1 Bar | | |
| 3 | 1 Bar | 1 Bar | |
| 4 | 1 Bar | 1 Bar | |
| 5 | 1 Bar | | |
| 6 | | 2 Bar | 0 Bar |
| 7 | 3 Bar | | 0 Bar |
| 8 | | 7 Bar | 0 Bar |
| 9 | 7 Bar | | |
| 10 | | 3 Bar | 1 Bar |
| 11 | 3 Bar | | |
| 12 | | 1 Bar | |
| 13 | 0 Bar | | |
| 14 | 0 Bar | Devil | |
| 15 | | | |
| 16 | Devil | 1 Bar | 7 Bar |
| 17 | | | |
| 18 | 3 Bar | 2 Bar | |
| 19 | | | |
| 20 | 2 Bar | 1 Bar | |
| 21 | 2 Bar | | |
| 22 | | 3 Bar | 1 Bar |
| 23 | 7 Bar | | |
| 24 | | 0 Bar | 1 Bar |
| 25 | 2 Bar | 0 Bar | |
| 26 | | | |
| 27 | 1 Bar | | |
| 28 | 1 Bar | | |
| 29 | 1 Bar | | |
| 30 | 1 Bar | | Devil |

Fig.11C

| No. | 1st REEL | 2nd REEL | 3rd REEL |
|---|---|---|---|
| 31 | | | |
| 32 | | | |
| 33 | | | |
| 34 | | | |
| 35 | | | |
| 36 | | | 0 Bar |
| 37 | | | 0 Bar |
| 38 | | | 0 Bar |
| 39 | | | |
| 40 | | | 3 Bar |
| 41 | | | |
| 42 | | | |
| 43 | | | 1 Bar |
| 44 | | | |
| 45 | | | 2 Bar |
| 46 | | | |
| 47 | | | 0 Bar |
| 48 | | | 0 Bar |
| 49 | | | |
| 50 | | | |
| 51 | | | |
| 52 | | | |
| 53 | | | |
| Angel | 1 | 1 | 1 |
| Devil | 1 | 1 | 1 |
| 7 Bar | 2 | 1 | 1 |
| 3 Bar | 3 | 2 | 1 |
| 2 Bar | 3 | 2 | 1 |
| 1 Bar | 8 | 5 | 4 |
| 0 Bar | 2 | 2 | 8 |
| Blank | 12 | 14 | 37 |
| Total | 32 | 28 | 54 |
| | | | |
| Tape No | Reel 1 | Reel 2 | Reel 3 |

Fig.12 A

| | | | |
|---|---|---|---|
| No. | 1st REEL | 2nd REEL | 3rd REEL |
| 0 | Angel | Angel | Angel |
| 1 | | | |
| 2 | 1 Bar | 1 Bar | 0 Bar |
| 3 | | | |
| 4 | 3 Bar | 2 Bar | 1 Bar |
| 5 | | | |
| 6 | 7 Bar | 7 Bar | 7 Bar |
| 7 | | | |
| 8 | 3 Bar | 3 Bar | 1 Bar |
| 9 | | | |
| 10 | 0 Bar | 1 Bar | 1 Bar |
| 11 | | | |
| 12 | Devil | Devil | Devil |
| 13 | | | |
| 14 | 3 Bar | 1 Bar | 0 Bar |
| 15 | | | |
| 16 | 2 Bar | 2 Bar | 3 Bar |
| 17 | | | |
| 18 | 7 Bar | 1 Bar | 1 Bar |
| 19 | | | |
| 20 | 2 Bar | 3 Bar | 2 Bar |
| 21 | | | |
| 22 | 1 Bar | 0 Bar | 0 Bar |
| 23 | | | |
| Angel | 1 | 1 | 1 |
| Devil | 1 | 1 | 1 |
| 7 Bar | 2 | 1 | 1 |
| 3 Bar | 3 | 2 | 1 |
| 2 Bar | 2 | 2 | 1 |
| 1 Bar | 2 | 4 | 4 |
| 0 Bar | 1 | 1 | 3 |
| Blank | 12 | 12 | 12 |
| Total | 24 | 24 | 24 |
| | | | |
| Tape No | Reel 1 | Reel 2 | Reel 3 |

Fig. 12 B

| No. | 1st REEL | 2nd REEL | 3rd REEL |
|---|---|---|---|
| 0 | Angel | Angel | Angel |
| 1 | | | |
| 2 | | | |
| 3 | 1 Bar | 1 Bar | |
| 4 | 1 Bar | 1 Bar | |
| 5 | 1 Bar | | |
| 6 | 1 Bar | 2 Bar | 0 Bar |
| 7 | | | 0 Bar |
| 8 | 3 Bar | 7 Bar | 0 Bar |
| 9 | | | 0 Bar |
| 10 | 7 Bar | 3 Bar | |
| 11 | | | 1 Bar |
| 12 | 3 Bar | 1 Bar | |
| 13 | | | |
| 14 | 0 Bar | Devil | |
| 15 | | | |
| 16 | Devil | 1 Bar | 7 Bar |
| 17 | | | |
| 18 | 3 Bar | 2 Bar | |
| 19 | | | |
| 20 | 2 Bar | 1 Bar | |
| 21 | 2 Bar | | |
| 22 | | 3 Bar | 1 Bar |
| 23 | 7 Bar | | |
| 24 | | 0 Bar | 1 Bar |
| 25 | 2 Bar | 0 Bar | |
| 26 | | | |
| 27 | 1 Bar | | |
| 28 | 1 Bar | | |
| 29 | 1 Bar | | |
| 30 | 1 Bar | | Devil |

Fig.12C

| No. | 1st REEL | 2nd REEL | 3rd REEL |
|---|---|---|---|
| 31 | | | |
| 32 | | | |
| 33 | | | |
| 34 | | | |
| 35 | | | |
| 36 | | | 0 Bar |
| 37 | | | 0 Bar |
| 38 | | | 0 Bar |
| 39 | | | |
| 40 | | | 3 Bar |
| 41 | | | |
| 42 | | | 1 Bar |
| 43 | | | |
| 44 | | | 2 Bar |
| 45 | | | |
| 46 | | | 0 Bar |
| 47 | | | 0 Bar |
| 48 | | | 0 Bar |
| 49 | | | |
| 50 | | | |
| 51 | | | |
| 52 | | | |
| 53 | | | |
| Angel | 1 | 1 | 1 |
| Devil | 1 | 1 | 1 |
| 7 Bar | 2 | 1 | 1 |
| 3 Bar | 3 | 2 | 1 |
| 2 Bar | 3 | 2 | 1 |
| 1 Bar | 8 | 5 | 4 |
| 0 Bar | 1 | 2 | 10 |
| Blank | 13 | 14 | 35 |
| Total | 32 | 28 | 54 |
| | | | |
| Tape No | Reel 1 | Reel 2 | Reel 3 |

Fig.13

| Hit Combinations | |
|---|---|
| ROYAL FLUSH | 250 |
| STRAIGHT FLUSH | 50 |
| FOUR OF A KIND | 25 |
| FULL HOUSE | 6 |
| FLUSH | 5 |
| STRAIGHT | 4 |
| THREE OF A KIND | 3 |
| TWO PAIR | 2 |

SLOT MACHINE WITH PAYOUT MODIFYING SYMBOLS

This application is a Continuation of application Ser. No. 07/412,985, filed Sep. 26, 1989, now abandoned.

BACKGROUND OF THE INVENTION

1. Field of the Invention

This invention relates to a game machine in which preset characters are selected based on random numbers, and the presence of a win is determined.

2. Related Background Art

Game machines, e.g., slot machines, are started by the insertion of coins or medals into slots formed in the bodies and the operation of the start levers or the like to rotate simultaneously a plurality of reels having a plurality of kinds of symbols depicted on the outer peripheries. The reels have the same number of symbols arranged on the outer peripheries.

FIG. 1 shows symbol rows provided on reel outside peripheries of a conventional slot machine. Conventionally, all the reels have symbol rows having the same number of symbols depicted on the outer peripheries. Each symbol row has 16 symbols which correspond to stop positions (16 positions) of the reel. That is, one point on each of the symbols arranged on the reel outside peripheries is one of the stop positions. Each symbol row has e.g., 4 kinds of symbols (7B, 5B, 1B, blank). Winning combinations are ranked in the order of (1) 7B-7B-7B, (2) 5B-5B-5B and (3) 1B-1B-1B. For example, (1) 7B-7B-7B wins 100 points, (2) 5B-5B-5B wins 60 points, and (3) 1B-1B-1B wins 10 points. Based on these points, the payments of coins are pre-set.

Some slot machines include special symbols (e.g., "WILD") which can be accepted as different winning symbols. To give an example of this case, even when a combination of symbols along a winning line cannot be a winning combination because of one different symbol [WILD] (e.g., 7B-7B-WILD), [WILD] can be accepted as [7B], and this combination can gain 100 points as does (1) 7B-7B-7B.

But the conventional slot machines are common in developments of their games. A slot machine of which the game is more amusing and develops more positively is expected among the players.

"WILD" is a symbol simply for avoiding "LOST" of a game but does not positively develop the game. What has been described above is the same with other game machines, as of poker game machine, etc., which select preset characters based on random numbers and determine the presence of a win.

SUMMARY OF THE INVENTION

An object of this invention is to provide a game machine of which the game is highly amusing and develops innovationally and positively.

In order to achieve this object, the game machine according to this invention judges a combination of the characters stopped along a winning line, based on a winning combination table so as to determine the presence of a win and a payment of coins, and is characterized by a substitutable character which can be used for a different character, and when its use as a different character makes a combination of characters a win, a payment of coins is increased or decreased to determine a new payment of coins.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 1 is a view of rows of symbols arranged on the outside peripheries of the reels of a conventional slot machine;

FIG. 5 is a view of ranked winning combinations of symbols;

FIG. 6A is a view of a first example of arrangement of external symbols usable in the slot machine according to the first embodiment;

FIG. 6B is a view of a first example of arrangement of internal symbols usable in the slot machine according to the first embodiment;

FIG. 7A is a view of a second example of arrangement of external symbols usable in the slot machine according to the first embodiment;

FIGS. 7B and 7C are a view of a second example of arrangement of internal symbols usable in the slot machine according to the first embodiment;

FIG. 8A is a view of a third example of arrangement of external symbols usable in the slot machine according to the first embodiment;

FIGS. 8B and 8C are a view of a third example of arrangement of internal symbols usable in the slot machine according to the first embodiment;

FIGS. 9A and B are tables showing wins finally determined for the symbols on winning lines A, B and C;

FIG. 11A is a view of a fourth example of arrangement of external symbols usable in the slot machine according to the second embodiment;

FIGS. 11B and 11C are a view of a fourth example of arrangement of internal symbols usable in the slot machine according to the second embodiment;

FIG. 12A is a view of a fifth example of arrangement of external symbols usable in the slot machine according to the second embodiment;

FIGS. 12B and 12C are a view of a fifth example of arrangement of internal symbols usable in the slot machine according to the second embodiment; and FIG. 13 is a table of winning combinations usable in a poker game according to another embodiment.

DESCRIPTION OF THE PREFERRED EMBODIMENT

Figure 2:
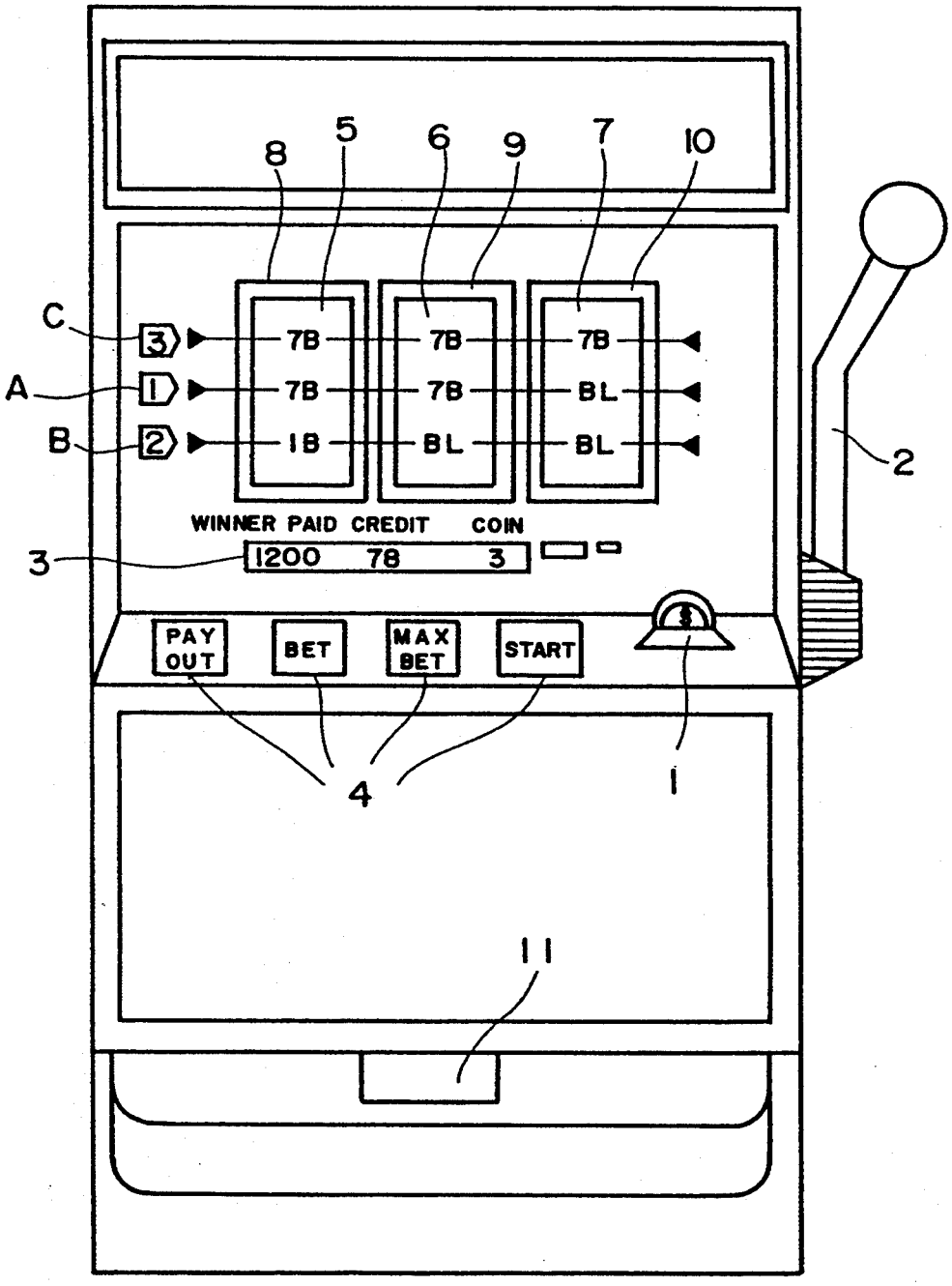
FIG. 2 is a front view of the appearance of the slot machine according to a first embodiment of this invention.

Firstly, a first embodiment of a slot machine as an example of the game machine according to this invention will be explained with reference to FIGS. 2 to 4. FIG. 2 shows the appearance of a three-reel slot machine to which this embodiment is adapted to. A player inserts 13 coins into a slot 1. Winning lines A, B, C to be effected are determined based on a number of the inserted coins. That is, when three coins are inserted, the winning probability becomes highest. The number of inserted coins is digitally indicated in a coin number display 3. The number of inserted coins may be indicated by lighting up LED lamps corresponding to a number (1, 2, 3). Then a start lever 2 of a game switch unit 4 is pulled, and stepping motors for rotating a first reel 5, a second reel 6 and a third reel 7 are actuated together. While the first, the second and the third reels are on rotation, rows of characters thereon are seen passing respective windows 8, 9, 10 provided for the respective reels, but the character rows come to pass the windows unidentifiably fast. These reels are driven by a microcomputer and a motor driving circuit. Stop positions of the respective reels are determined in accordance with random numbers generated by a random number generating unit 13. The stop position of the first reel 5 is determined when coins are inserted. Stop positions of the second reel 6 and the third reel 7 are determined when the game switch is pushed in or when the start lever 2 is pulled. The random number generating unit 13 has a 13 bit-register and generates 8192 ($=2^{13}$) random numbers. When the first, the second and the third reels 5, 6, 7 are stopped, the characters on the first, the second and the third reels 5, 6, 7 along the winning lines A, B and C are identified. The number of winning lines A, B and C to be effected is determined in accordance with the number of inserted coins. In the case where three coins have been inserted, wins are judged along all the winning lines A, B and C. In the case where one coin has been inserted, a win is judged only along the winning line A. When a winning combination of characters is found along any of the effected winning lines, the number of coins corresponding to the win is paid out at a coin discharge opening 11.

Simultaneously therewith, the number of inserted coins and the number of paid coins are indicated in the display 3. Thus, one game is finished. When no win is found along any of the winning lines A, B, C, one game is finished with no win.

When one game is started after a bet switch of the game switch unit 4 is pushed, coins are not paid out, but instead the number of coins to be paid out is displayed as a credit in the display 3. The number of credits is equivalent to the same number of coins. One push on the bet switch is equivalent to the insertion of one coin, and the number of credits in the display 3 is decreased by one. When the number of credits exceeding a maximum insertable number of coins is still left, a maximum bet switch is pushed, which is equivalent to the insertion of the maximum insertable number of coins. The number of credits in the display 3 is decreased by the maximum insertable number of coins. By pushing a pay-out switch of the game switch unit 4, coins are paid out at the coin discharge opening 11 in a number indicated in the display 3 as a credit.

Figure 3:
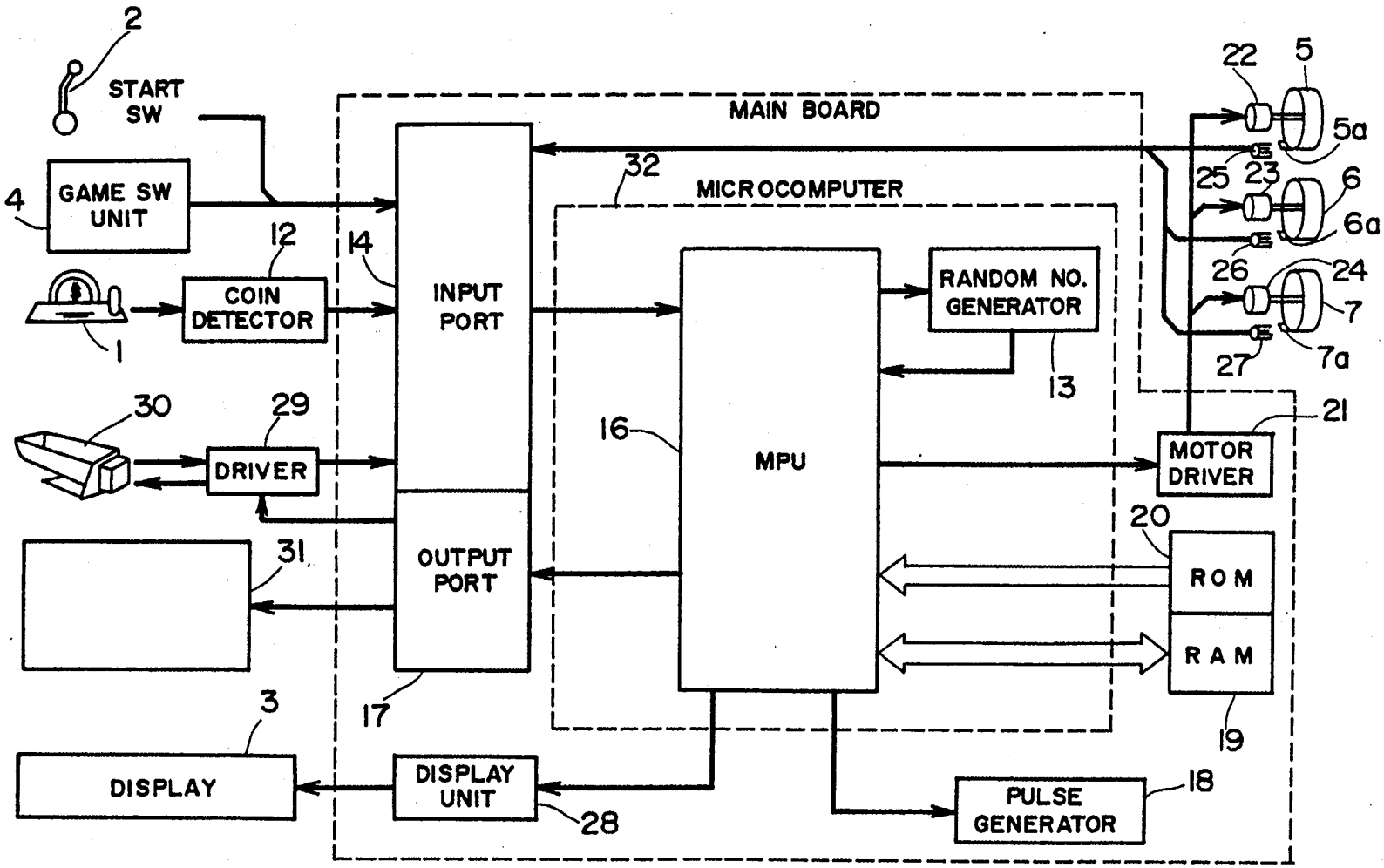
FIG. 3 is a functional block diagram of a circuit of the slot machine according to the first embodiment.
Figure 4:
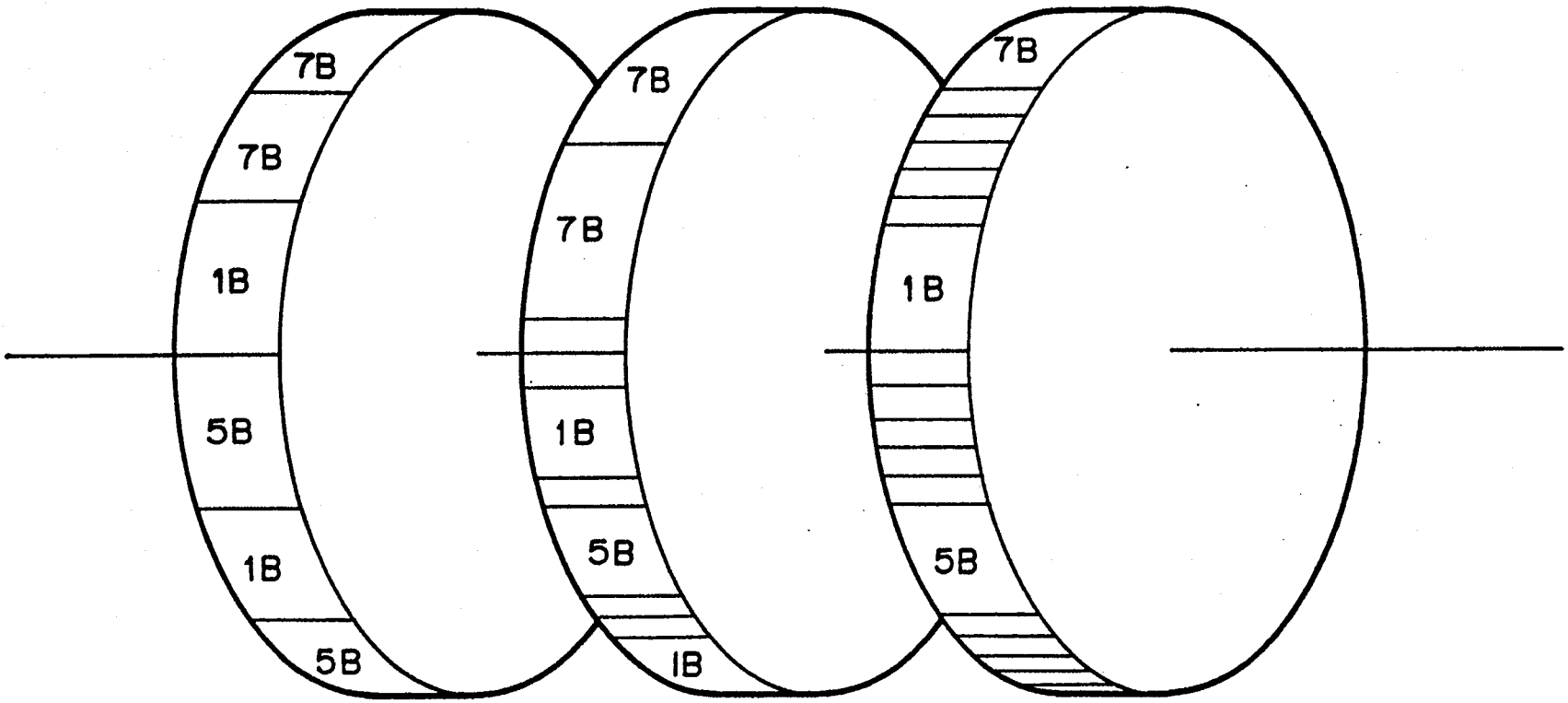
FIG. 4 is a perspective view of the appearance of a reel usable in the slot machine according to the first embodiment.

FIG. 3 shows a functional block diagram of a circuit configuration of the three-reel type slot machine. Before the game is started the coins thrown in from the coin port 1 are detected by a coin detector 12 one by one, and the count of detection pulses generated when the coins are detected is supplied to an MPU 18 as a coin count through an input port 14. The coin count supplied to the MPU 18 is stored in a RAM 19 by the MPU 18.

The MPU 18 converts the coin count to data for a display unit 28 and sends it to the display unit 28 so 20 that the display 3 displays the coin count supplied to the MPU 18. The coin count stored in the RAM 19 provides information relating to the winning lines validated in the game for the MPU 18. The winning table is stored in ROM 20 and the internal symbols corresponding to the stop positions of reels are separately stored for each reel in ROM When the player throws in the coins and manipulates the start switch on the game switch unit 4 or the start lever 2, the MPU 16 reads that information through the input port 14 and activates the motor driver 21 to rotate the stepping motors 22, 23 and 24. The MPU 16 now supplies a drive pulse to the motor driver 16 by reference to a pulse generated by a pulse generator 18. The first reel 5, second reel 6 and third reel 7 are coupled to drive shafts of the stepping motors 22, 23 and 24, respectively, so that the first reel 5, second reel 6 and third reel 7 are rotated with the stepping motors 22, 23 and 24. Many disproportion-type symbols of which the length in peripheral direction is different are arranged on the outer peripheries of each reel. Each symbol corresponds to a stop position. The symbol L of which peripheral length is long has a character such as "7B" or "5B", etc. drawn and the symbol S of which peripheral length is short has blank (hereinafter referred as "BL"). Accordingly, all characters are not arranged on the outer peripheries of each reel continuously (FIG. 4.)

The numbers of pulses supplied to the stepping motor 22, 23 and 24 are stored in the RAM 19 from the MPU 16. Since the rotation angles of the stepping motors 22, 23 and 24 change with the numbers of pulses, the MPU 16 can uniquely determine the rotation positions of the stepping motors 22, 23 and 24.

Projections 5*a*, 6*a* and 7*a* for producing reset signals are provided on the portions of the circumferences of the first reel 5, second reel 6 and third reel 7 attached to the drive shafts of the stepping motors 23 and 24. The projections 5*a*, 6*a* and 7*a* are detected by photo-sensors 25, 26 and 27, respectively, in each revolution of the reels, and the detection signals are used to determine reference positions of the reels.

In this manner, the MPU 16 can determine the numbers of pulses to be supplied to the stepping motors in order to reach the stop positions of the reels. The symbol position on the winning line when the first reel 5, second reel 6 and the third reel 7 stop correspond to the numbers of pulses supplied to the stepping motors from the MPU In the determination of winning, the winning lines validated by the number of coins thrown in are taken into consideration. In the case of the winning, the coins are paid out from the exit 11, or if the bet switch of the game switch 4 has been depressed, the number of coins to be paid out is displayed on the display 3 as credit. The MPU 16 supplies a hopper drive signal to a driver 29 through an output port 17 so that the hopper is driven and the coins are paid out. Each time the coin is paid out, a microswitch in the hopper is actuated to generate a pulse.

The pulse is sent to the MPU 16 through a driver and an input port 14. Since the number of pulses sent to the MPU 16 corresponds to the number of coins paid out, the MPU 18 can determine the exact number of coins paid out.

When the number of pulses supplied reaches the number of coins to be paid out, the MPU 16 sends a hopper stop signal to the driver 29 through the output port 17 so that the hopper is stopped.

When the coins have been paid out, the number of coins paid out is displayed on the display 3. The number of coins thrown in for the game is not erased until new coins are thrown in for the next game.

A winning combination table of ranked symbols which are usable in the slot machine described above will be explained with reference to FIG. 5. The symbols are eight kinds, [Angel], [Devil], [7 Bar], [Bar], [2 Bar], [1 Bar], [0 Bar], [Blank] which are ranked in the stated order. What has to be noted here is that [Angel] (a rank-up symbol) can be used as the most highly ranked symbol in a combination of symbols positioned along a effected winning line, and this substitution makes the combination a winning one, the number of coins for the winning combination being determined for a rank higher by one rank, and [Devil] (a rank-down symbol) can be used as the most highly ranked symbol in a combination of symbols positioned along a effected winning line, and this substitution makes the combination a winning one, the number of coins for the winning combination being determined for a rank lower by one rank. Next, examples of the arrangement of the symbols on the external reels (hereinafter called "external symbols") of the above-described slot machine and of the arrangement of the symbols on the internal (virtual) reels (hereinafter called "internal symbols") stored by ROM 20, and a method of judging a win will be explained with reference to FIGS. 6 to 9. FIGS. 6 to 8 show examples of arrangement of symbols. FIG. 9 is a finally judged winning combination table for combinations of symbols along the winning lines A, B, C to be compared with. The first, the second, and the third reels 5, 6, 7 each have 24 external symbols.

FIGS. 6A and 6B show the external and the internal symbols of the slot machine according to a first example of arrangement. In this example of arrangement, 32 internal symbols are assigned to the first reel 5, 16 internal symbols are assigned to the second reel 6 and 16 internal symbols are assigned to the third reel 7. One stop position is allocated to every internal symbol. That is, the first reel 5 can stop at 32 different rotation angles, and the second and the third reels 6, 7 can stop respectively at 16 different rotation angles. These internal symbols correspond to random numbers outputted by the random number generating unit 13. Accordingly the internal symbols are identified by random numbers, and the reels are stopped at stop positions corresponding to the identified internal symbols. The images (external symbols) seen at the windows 8, 9, 10 are identified by these stop positions. In this case, the value given by multiplying the total numbers of the internal symbols on the respective reels (the first reel: 32, the second reel: 16, the third reel: 16) is 8192 ($=32\times16\times16$). This value is equal to a total number of random numbers 8192 ($=2^{13}$) generated upon determining the presence of a win. This results in a game which develops naturally without partiality and intention. In the case where a slot machine is designed with the probability of occurrences of winning symbols preset, the degree of freedom is so wide that a slot machine can be designed easily.

FIGS. 7A, B and C show external symbols and internal symbols of the slot machine according to a second example of arrangement. In this example of arrangement, 4 different stop positions are set on the outside periphery of the first reel 5 in the symbol region of a winning symbol [1 Bar]. One symbol is allocated to each of the stop positions. In FIG. 7A, for example, when the first reel 5 stops at No. 0, the second reel 6 stops at No. 0, and the third reel 7 stops at No. 6, combinations of symbols along the winning lines correspond to No. 3 (see FIG. 9A), and a combination of symbols [Angle-Angel-7 Bar] is displayed along the winning line A. In this combination, since the two [Angel]s can be used as [7 Bar]s, this combination formally corresponds to [7 Bar-7 Bar-7 Bar]. But since [Angel] is a rank-up symbol, this combination is finally judged to be [Angle-Angel-Angel] which is higher than [7 Bar-7 Bar-7 Bar] by two ranks. Assuming that one coin has been inserted, coins will be paid based on not 100 points but 600 points.

FIGS. 8A, B and C show the external symbols and the internal symbols of the slot machine according to a third example of arrangement. A difference of this third example from the second example is that in this example total numbers of [0 Bar] and [Blank] of the internal symbols of the second and the third reels 6, 7 are changed so as to raise the pay-out ratio. In FIG. 8A, for example, when the first reel 5 stops at No. 12, the second reel 6 stops at No. 12, and the third reel 7 stops at No. 4, combinations of symbols along the winning lines correspond to No. 43 (see FIG. 9B), and a combination of symbols, [Devil-Devil-1 Bar] is displayed in the windows 8, 9, 10 along the winning line A. In this combination, since the two [Devil]s can be used as [1 Bar], this combination formally corresponds to [1 Bar-1 Bar-1 Bar], but since [Devil] is a rank-down symbol, this combination is judged to be [A Bar-A Bar-A Bar] which is lower than [1 Bar-1 Bar-1 Bar] by two ranks. If one coin has been inserted, accordingly coins will be paid based on not 10 points but 5 points.

A second embodiment of the slot machine is now explained with reference to FIGS. 9 to 12. A construction of the slot machine of the present embodiment is first explained with reference to FIG. 10. Since an external view of the slot machine is essentially the same as that of the first embodiment, the explanation thereof in omitted.

Figure 10:
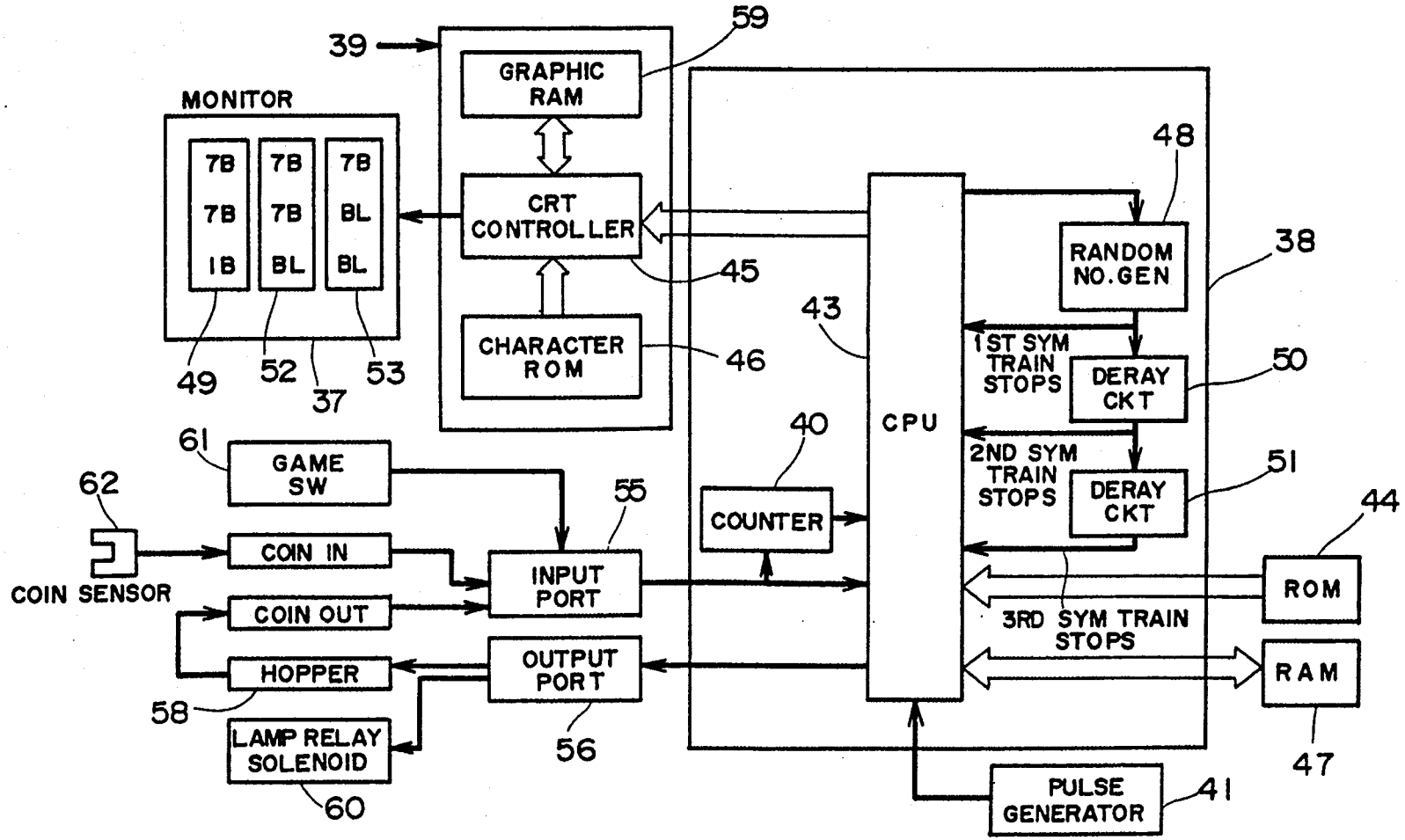
FIG. 10 is a functional block diagram of a circuit of the slot machine according to a second embodiment of this invention.

FIG. 10 shows a video-type slot machine in accordance with the present invention. It shows a functional block diagram of a circuit configuration of a three-reel type slot machine. A CRT 37 is provided at the position of reels in the video-type slot machine. The CRT 37 is driven by a micro computer 38 and a CRT driver 39, and nine symbols in total are displayed in matrix on the display screen.

Before the game is started, the number of coins thrown in is counted by a counter 40 with the data supplied from an input port 55. The number of effective lines for the winning lines on the display screen is determined by the number of coins thrown in. The winning effective lines are referenced in determining the winning.

When a start button is depressed, a clock pulse is supplied from a pulse generator 41 to the CPU 43 and a microcomputer 38 is activated. The microcomputer 38 processes the game in accordance with a game program stored in a ROM 44. As the microcomputer 38 is activated, a CRT controller 45 is activated and the character data of the symbols to be displayed on the CRT 37 from a character ROM 37 are accessed in an address sequence so that the symbols are displayed with scrolling. The ROM 44 stores, in addition to the game program, the contents of three symbol tables corresponding to the mechanical reels, internal symbol table corresponding to the symbol tables and a winning table.

The displayed symbol address data is held while it is sequentially updated in a RAM 47. After a predetermined time period, the scrolling of the first symbol train 49 vertically displayed on the CRT 37 is stopped by a stop signal generated by a random number generator 48 so that three symbols are specified. By stop signals sequentially produced from delay circuits 50 and 51, the scrolling of the second symbol train 52 and the third symbol train 53 is stopped. In this manner, nine symbols in total are specified. The random number generator 48 comprises a 12-bit register which generates 4096 ($=2^{12}$) random numbers. The stop positions in the symbol trains are specified in accordance with the random numbers.

The RAM 47 stores the address data of the symbols displayed on the CRT 37 and the display position data. When the scrolling of all symbol trains 49, 52 and 53 stops, whether the combination of symbols displayed along the validated winning line is the winning combination or not is determined. The address date stored in the winning table memory of the ROM 44 and the data stores in the RAM 47 are compared to get the determination of the winning.

In order to display the symbols which constitute the winning combination distinctively from other symbols, the background of the symbols may be changed or color tone of the symbols may be reversed to that of regular display colors. The CPU 43 has input port 55 and output port 56 connected thereto. The output port 56 supplies a drive signal to a hopper 58 in response to a signal from the CPU 43. The hopper 58 pays out a predetermined number of coins corresponding the type of winning in response to the signal from the output port 56. When the hopper 58 has paid out the predetermined number of coins, a normal symbol display mode is restored and the slot machine is reset to the initial state.

Examples of the arrangement of the symbols scrolled by the CRT 37 (hereinafter called "scroll symbol") of the above-described slot machine and the symbols arranged on the internal reels stored in the ROM 44 will be explained with reference to FIGS. 11 and 12.

FIG. 11A, FIG. 11B and FIG. 11C show the scroll symbols and the internal symbols of the slot machine according to a fourth example of arrangement. In this fourth example, 4 different stop positions are set on symbol rows 49 of the scroll symbols for the winning symbol [1 Bar]. One internal symbol is allocated to each of the stop positions. For example, in FIG. 11A, when the a first symbol row 49 stops at No. 0, a second symbol row 52 stops at No. 12, and a third symbol row 53 stops at No. 4, combinations of winning symbols along the winning lines correspond to No. 24 (see FIG. 9A), and a combination of symbols, [Angel-Devil -1 Bar] is displayed on a monitor. In this combination, since [Angel] and [Devil] can be used as [1 Bar]s, this combination formally corresponds to [1 Bar-1 Bar-1 Bar]. But, since [Angel] is a rank-up symbol, while [Devil] is a rank-down symbol, their ranks are compensated, and this combination is finally judged to be [1 Bar-1 Bar-1 Bar]. If one coin has been inserted, accordingly coins are paid out based on 10 points.

FIG. 12A, FIG. 12B and FIG. 12C show the scroll symbols and the internal symbols of the slot machine according to a fifth example of arrangement. A difference of this fifth example of arrangement from the fourth example is that in the fifth example, total numbers of [0 Bar] and [Blank] of the internal symbols in the symbol rows 49 and 53 are varied from each other so as to raise the pay-out ratio. For example, in FIG. 12A, when the first symbol row 49 stops at No. 12, the second symbol row 52 stops at No. 12, and the third symbol row 53 stops at No. 4, combinations of symbols along the winning line correspond to No. 43 (see FIG. 9B), and a combination of symbols [Devil-Devil-1 Bar] is displayed on the monitor. In this combination, since [Devil] can be used as [1 Bar], this combination formally corresponds to [1 Bar-1 Bar-1 Bar]. But since [Devil] is a rank-down symbol, this combination is finally judged to be [A Bar-A Bar-A Bar] which is lower than [1 Bar-1 Bar-1 Bar] by 2 ranks. If one coin has been inserted, accordingly coins will be paid based on 5 points.

This invention is not limited to the above-described embodiments. For example, the number of the reels, the number of symbols and the arrangement of the symbols are selected suitably depending on the game conditions. It is possible to use the arrangements according to the first, second and third examples in the second embodiment, and reversely the arrangements according to the fourth and fifth examples in the first embodiment.

The game machine according to this invention has been explained by means of embodiments in which the game machine is exemplified by a slot machine. But the game machine may be any machine as long as certain characters are selected based on random numbers, and the presence of a win is determined. An embodiment in which the game machine according to this invention is exemplified by a video poker game machine will be explained below. Since the game machine according to this embodiment can use the circuit of FIG. 10 except that different patterns are displayed on the monitor of the CRT 37, and more game switches 61 are provided, detailed explanation of this game machine will be omitted. FIG. 13 is a winning combination table showing the ranks of the winning combinations of characters. The characters contain [ANGEL JOKER] (a rank-up character), and [DEVIL JOKER](a rank-down character). The functions of these characters are the same as described above. For example, assuming that the characters displayed on a monitor are [2-2-4-6-ANGEL JOKER], [ANGEL JOKER] can be used as a character which can compose the highest ranked combination. In this combination, since the possible highest rank is a three of [2], [ANGEL JOKER] can be used as [2]. Then this combination formally corresponds to [2-2-4-6 -2]. But, since [ANGEL JOKER] is a rank-up character, [ANGEL JOKER] in this combination is finally judged to be a straight of [2] which is higher than a three of [2] by one rank. Accordingly coins are paid based on not 3 points but 4 points.

Here it is assumed that a combination characters, [2-2-4-6-DEVIL JOKER] is displayed on the monitor. [DEVIL JOKER] can be used as a character which can compose the highest ranked combination. Since the possible highest rank is a three of [2], [DEVIL JOKER-]is used as [2]. Then this combination formally corresponds to [2-2-4-6- 2]. But, since [DEVIL JOKER] is a rank-down character, this combination is finally judged to be two pair of [2], which is lower than a three of [2] by one rank. Accordingly coins are paid based on not 3 points but 2 points.

In addition, it is assumed that the characters displayed on a monitor are [2-2-4-DEVIL JOKER ANGEL JOKER]. The possible highest rank in this combination is four of [2]. In this combination, [ANGEL JOKER] is used as [2]. Then this combination formally corresponds to [2-2-4-2-2]. But since [ANGEL JOKER] is a rank-up character, and [DEVIL JOKER] is a rank-down character, the change of the ranking is compensated. This combination is finally judged to be of four of [2].

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. A game machine in which a combination of characters stopped along a predetermined line thereof is judged based on a predetermined table showing plural combinations of characters to determine the presence of a win and an amount of coins to be paid therefor, the game comprising:

a random number generator which generates a random number, having the highest number of random numbers satisfying $2^n$ wherein n is a positive integer, each random number corresponding to one of a plurality of symbol combinations to be used in a game;

storage means for storing character combinations, each of said character combinations consisting of characters and corresponding to each of said random numbers, said characters including at least one substitutable character which can be used as another character, and a substitution of the substitutable character makes the combination of characters a winning combination, said winning combination being determined based on predetermined ranks, the rank of the combination being changed according to number of substitutable characters contained in the combination;

selection means for selecting a character from each of said plurality of characters based on the random number to constitute a character combination;

detection means for detecting whether said character combination contains one or more substitutable characters;

character display means for displaying the characters selected and showing a plurality of characters in series, said characters being commonly used for said character combinations and including at least one substitutable character;

means for storing said predetermined ranks and characters to be used for said character combinations;

display controller means which retrieves from the ranks and characters storing means the character in the character combination corresponding to the random number generated by said random number generator and controls the display of said characters in series by said character display;

changing means for changing a pay-out when a winning character combination includes at least one substitutable character; and pay-out means for paying out an amount of coins corresponding with the last rank after said changing means complete changing of rank for all substitutable characters displayed by said display means;

wherein $2^n$ and the total number of character combinations are equal to each other.

2. A game machine according to claim 1, wherein said substitutable character is a rank-up character of which substitution makes a combination of characters a winning combination, the combination is ranked higher, and a payment of coins is increased for the combination.

3. A game machine according to claim 1, wherein said substitutable character is a rank-down character of which substitution makes a combination of characters a winning combination, the combination is ranked lower, and a payment of coins is decreased for the combination.

4. A game machine according to claim 1, wherein said substitutable character includes a rank-up character of which substitution makes a combinational of characters a winning combination, ranking the combination higher and increases a payment of coins for the combination; and a rank-down character of which substitution makes a combination of characters a winning combination, ranking the combination lower and decreases a payment of coins for the combination.

5. A game machine according to claim 1, further comprising a plurality of reels, each of which has a plurality of characters in series arranged thereon, said characters including at least one substitutable character which can be used as a different character thereof.

6. A game machine according to claim 5 wherein the machine is a slot machine.

7. A game machine according to claim 6, wherein said substitutable character is a symbol on (the peripheries out of said reels) of (a out slot machine.)

8. A game machine according to claim 6 wherein said character display means include a CRT screen with symbol rows and said substitutable character is a symbol included in the symbol rows scrolled on the CRT screen of the slot machine.

9. A game machine according to claim 6, wherein said substitutable character is a symbol stored in a memory for the reels of the slot machine.

10. A game machine according to claim 6, wherein said substitutable character is a symbol on outside peripheries of the reels of the slot machine, and stored in a memory for the respective reels.

11. A game machine according to claim 6, wherein said character display means include a CRT screen with symbol rows and said substitutable character is a symbol included in the symbol rows scrolled on the CRT screen of the slot machine, and stored in a memory for the respective reels.

12. A game machine according to claim 6, wherein said substitutable character is a symbol on the outside peripheries of the reels of the slot machine.

13. A game machine according to claim 6, wherein said substitutable character is a symbol stored in a memory of the slot machine for the respective reels, and a multiple of the total number of symbols stored in the memory for the respective reels is equal to a total number of random numbers based on which the presence of a win is judged.

14. A game machine according to claim 1, wherein the substitutable character is a character which is read by the detection means as another character necessary to have a winning combination and is communicated by the detection means to the changing means to modify the pay-out ratio based on the at least one substitutable character present.

15. A game machine according to claim 1, wherein said total number of combinations is $L \times M \times N$, wherein L is the number of characters in a first series of characters, M is the number of characters in a second series of characters, and N is the number of characters in a third series of characters, at least one of L, M and N being different than at least one of the other two.

16. A game machine in which a combination of characters stopped along a predetermined line thereof is judged based on a predetermined table showing plural combinations of characters to determine the presence of a win and an amount of coins to be paid therefor, the game machine comprising:

a random number generator which generates a random number, having the highest number of random numbers satisfying $2^n$ wherein n is a positive integer, each random number corresponding to one of a plurality of symbol combinations to be used in a game, a plurality of reels, each of said reels being mounted for rotation about an axis through a predetermined number of peripheral positions represented by a plurality of numbers, characters fixed to each of said reels to indicate the peripheral position of each of said reels, each of said characters corresponding to at least one of said plurality of numbers, and at least one of said characters being assigned to a substitutable character, rotation means for randomly selecting one of said plurality of numbers for said reels about said axis, selection means for randomly selecting one of said plurality of numbers for each of said reels, storage means for storing character combinations, each of said character combinations consisting of characters and corresponding to each of said random numbers, at least one of said characters including a substitutable character which can be used as another character, and a substitution of the substitutable character making the combination of characters a winning combination, said winning combination being determined based on predetermined ranks, the rank of the combination being changed according to the number of substitutable characters contained in the combination, detection means for detecting a selected combination constituted by said characters, each of said characters corresponding to the number selected by said selection means, and for detecting whether said selected combination includes one or more substitutable characters and whether all characters of the selected combination without said substitutable characters constitute one of said winning combinations, changing means for changing the ban-out ratio corresponding to the selected combination to another, different pay-out ratio stored by said storage means when the selected combination includes said substitutable character and all characters of the selected combination without said substitutable character constitute one of said winning combinations, means for stopping said reels at the peripheral position represented by the selected number, and pay-out means for paying out an amount of coins corresponding with the last rank after said changing means complete changing of rank of all substitutable characters displayed by said display means, wherein $2^n$ and the total number of character combinations are equal to each other.

17. A game machine according to claim 16, wherein the substitutable character is a character which is read by the detection means as another character necessary to have a winning combination and is communicated by the detection means to the changing means to modify the pay-out ratio based on the at least one substitutable character present.

18. A method for determining a payment of coins for a game machine by selecting characters to be stopped along a winning line in which a combination of the characters is compared with a winning table of ranks of winning combinations of characters to determine a payment of coins for the combination, the method comprising selecting a random number, selecting a combination of characters which corresponds to said random number based on a predetermined table, the characters in the combination of characters including characters which are substitutable for other characters, ranking combinations of characters that can appear along a winning line from the winning table of ranks, changing the rank of a combination of characters if at least one character which is substitutable for other characters appears along the winning line and checking each character wherein the changing in rank corresponds to a predetermined affect assigned to each character which is substitutable for other characters, wherein the total number of random numbers satisfies $2^n$ wherein n is a positive integer, each random number corresponding to one of a plurality of symbol combinations to be used in a game, and $2^n$ and a total number of character combinations are equal to each other.

19. A method for determining a payment of coins for a game machine according to claim 18, wherein when a substitution of said substitutable character makes a combination of characters a winning combination, the combination is ranked higher, and a payment of coins is increased.

20. A method for determining a payment of coins for a game machine according to claim 18, wherein when a substitution of said substitutable character makes a combination of characters a winning combination, the combination is ranked lower, and a payment of coins is decreased.

21. A method for determining a payment of coins for a game machine according to claim 18, wherein said game machine is a slot machine comprising reels, and said substitutable character is a symbol to be displayed along a winning line when the reels of the slot machine are stopped.

22. A method for determining a payment of coins for a game machine according to claim 18, wherein said game machine is a video slot machine comprising a CRT screen with visual reels, and said substitutable character is a symbol to be displayed along a winning line when the reels of the video slot machine stop scrolling on the CRT screen.

23. A method for determining a payment for a game machine according to claim 18, wherein said game machine is a video poker game comprising a CRT screen, and wherein said substitutable character is a card to be displayed on the CRT screen of the video poker game.

* * * * *